US005299836A

United States Patent [19]

Woods

[11] Patent Number: 5,299,836

[45] Date of Patent: Apr. 5, 1994

[54] FLOOR WASTE FITTING SUPPORT

[76] Inventor: Robert J. Woods, 28 Hawdon Close, Camden, New South Wales, 2570, Australia

[21] Appl. No.: 773,624

[22] PCT Filed: Mar. 1, 1991

[86] PCT No.: PCT/AU91/00070

§ 371 Date: Nov. 14, 1991

§ 102(e) Date: Nov. 14, 1991

[87] PCT Pub. No.: WO91/14838

PCT Pub. Date: Oct. 3, 1991

[30] Foreign Application Priority Data

Mar. 21, 1990 [AU] Australia ..... PK5135
Jun. 19, 1990 [AU] Australia ..... PK0682

[51] Int. Cl.[5] ..... E03C 1/12; F16L 5/02

[52] U.S. Cl. ..... 285/42; 52/232; 210/165; 404/2

[58] Field of Search ..... 52/34, 232, 169.5; 285/40; 404/2, 5; 210/163, 164, 165

[56] References Cited

U.S. PATENT DOCUMENTS 1,786,558 12/1930 Boosey ..... 285/42
1,828,601 10/1931 Frye ..... 285/42
1,941,537 1/1934 Boosey ..... 285/42
1,982,348 11/1934 Luff ..... 285/42
2,091,927 8/1937 Hirshstein ..... 285/42
2,490,075 12/1949 Matheis ..... 285/42
2,672,205 3/1954 McDonald ..... 285/42
4,730,854 3/1988 Cuschera ..... 285/42

*Primary Examiner*—Michael Safavi
*Attorney, Agent, or Firm*—Edwin D. Schindler

[57] ABSTRACT

A waste water fitting support assembly for merging seepage water with waste water which has passed through a waste water fitting, when mounted in a support member of the assembly, is disclosed. The assembly includes the support which has a body with a through bore and a flange around the entry end of the bore and a fall and cap member having a tubular body with a flange at one end of the body. The support passes through the fall and cap member and the flange of the support rests with the flange of the fall and cap member. The support bore has an entry portion of large diameter for providing a seepage water receiving zone and an exit portion of lesser diameter and an intermediate transition portion where there is a bore size reducing shoulder with associated abutment means for axially limiting the entry of a waste water fitting into the bore and where there is means for axially sliding frictional engagement by a waste water fitting to centrally position the waste water fitting in the body bore. Seepage water leakage paths extend through the abutment means to connect the seepage water receiving zone with the body bore downstream of the shoulder.

5 Claims, 4 Drawing Sheets

FIG. 1.
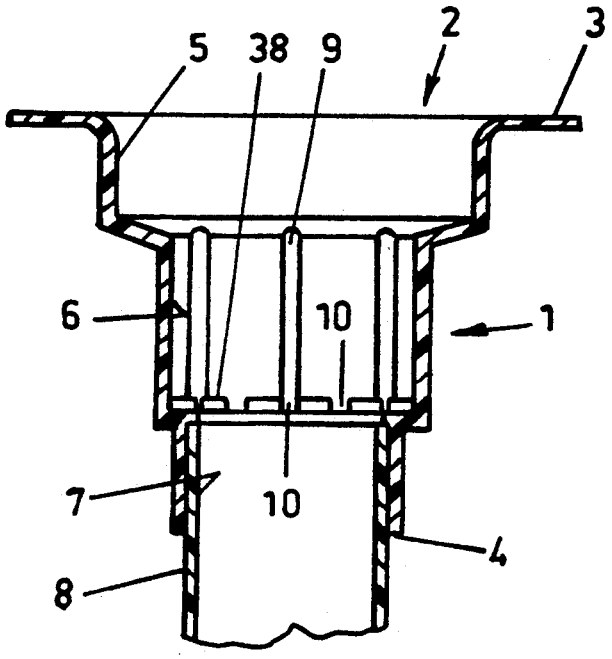
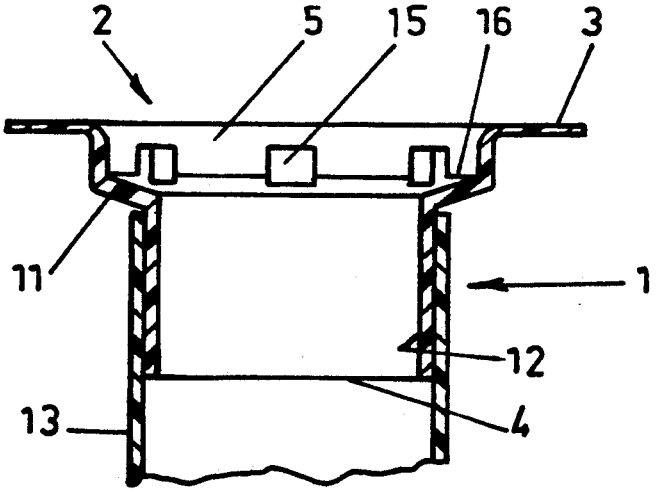
FIG. 2.

FLOOR WASTE FITTING SUPPORT

This invention relates to the drainage of waste water from the floor of a wet area, such as a shower recesses, and provides an improved support for the floor waste fitting.

Current building practice in the construction of bathroom and shower floors is to provide a flat wood, concrete, compressed asbestos sheet or fiber board floor and cover this flooring with ceramic tiles. Drainage of water from the surface is provided by having a floor waste fitting in the floor and angling the upper surface of the ceramic tiles towards the waste fitting such that surface water flows to the waste fitting.

Ceramic tiles are laid on a relatively dry morter mix which is inherently porous. This feature when associated with unavoidable cracking due to shrinkage when the mortar dries, means that the tiles and mortar do not present an impervious surface to any water which spills on the floor.

If water falling on the tiled surface passes through the mortar and is trapped between the tiles and the underlying floor it cannot pass into the waste fitting, which has its entry point on the tile upper surface. In such cases the water will leach alkalis from the mortar to form a concentrated alkali solution which will attack the flooring underneath the tile mortar. Even if a water-resistant fiber board is used, laid on wood rafters, any water which leaks around the floor waste fitting hole in the fiber board will bypass the fiber board and attack the underlying rafters, causing wet-rot. In the case of concrete floors, corrosion of the reinforcement is likely to occur.

Accordingly, it is a main aim of the invention to provide an arrangement in which water trapped between the tiles and the underlying structure can be directed to the drain associated with the floor waste fitting thereby substantially eliminating the incidence of water induced structural damage.

Broadly, the invention can be said to comprise a floor waste fitting support comprising a body, a passageway though the body from an inlet end to a discharge end of the body, said passageway including a first part adjacent said inlet body end which is larger in cross-section than the external dimension of a body part of a floor waste fitting to be supported, positioning means within said passageway to be engaged by the body part of a floor waste fitting thereby to position said floor waste fitting within said floor waste fitting support, water bypass means within said passageway to bypass said positioning means and place said first passageway part in permanent commuication with said passageway downstream from said positioning means, said body is adapted internally and/or externally at its discharge end for connection to a drain pipe.

Presently preferred embodiments of the invention will now be described with reference to the accompanying drawings in which:

FIG. 1 shows an axial cross-section of a first embodiment of the invention,

FIG. 2 shows an axial cross-section of a second embodiment of the invention,

Figure 3:
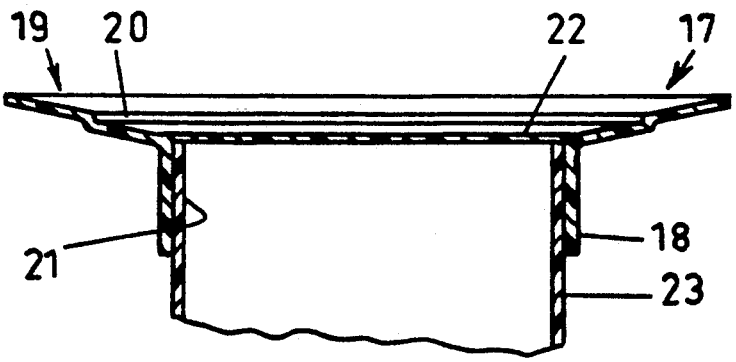
Figure 4:
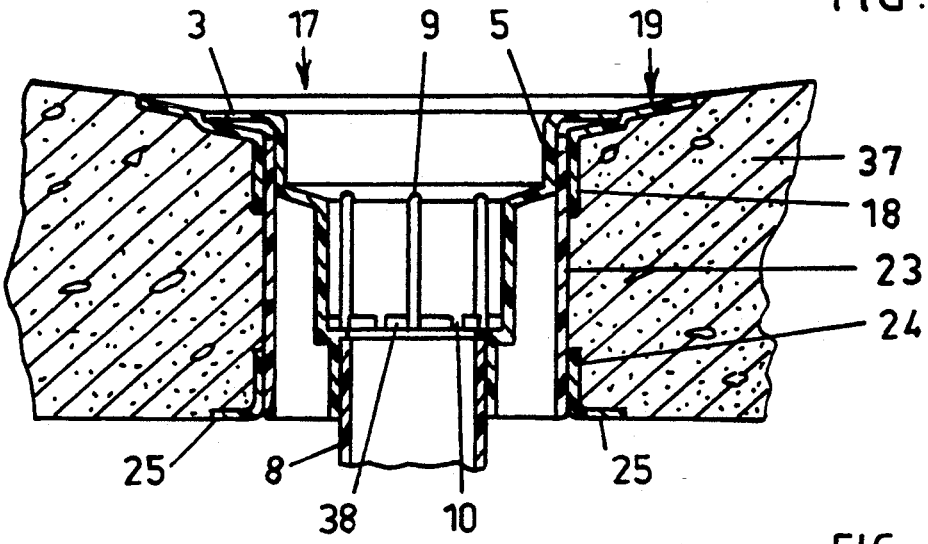
Figure 5:
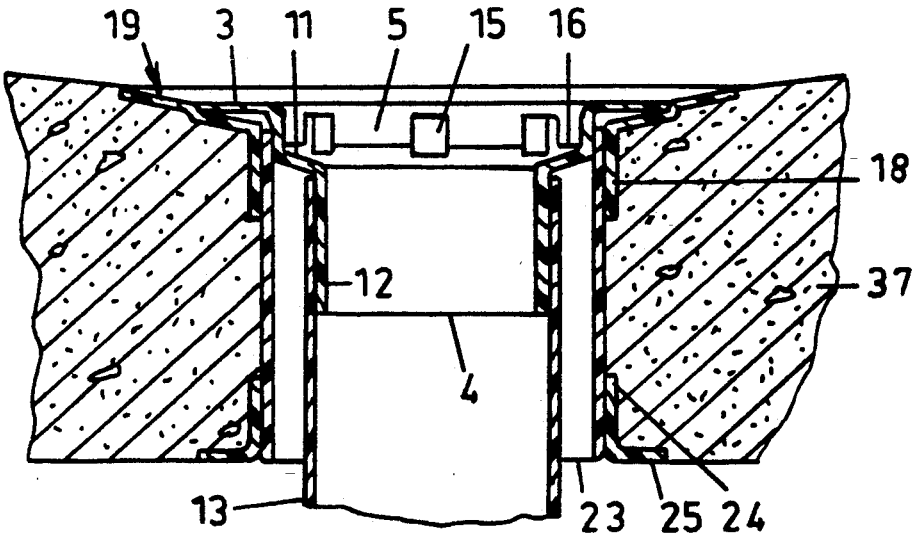
Figure 6:
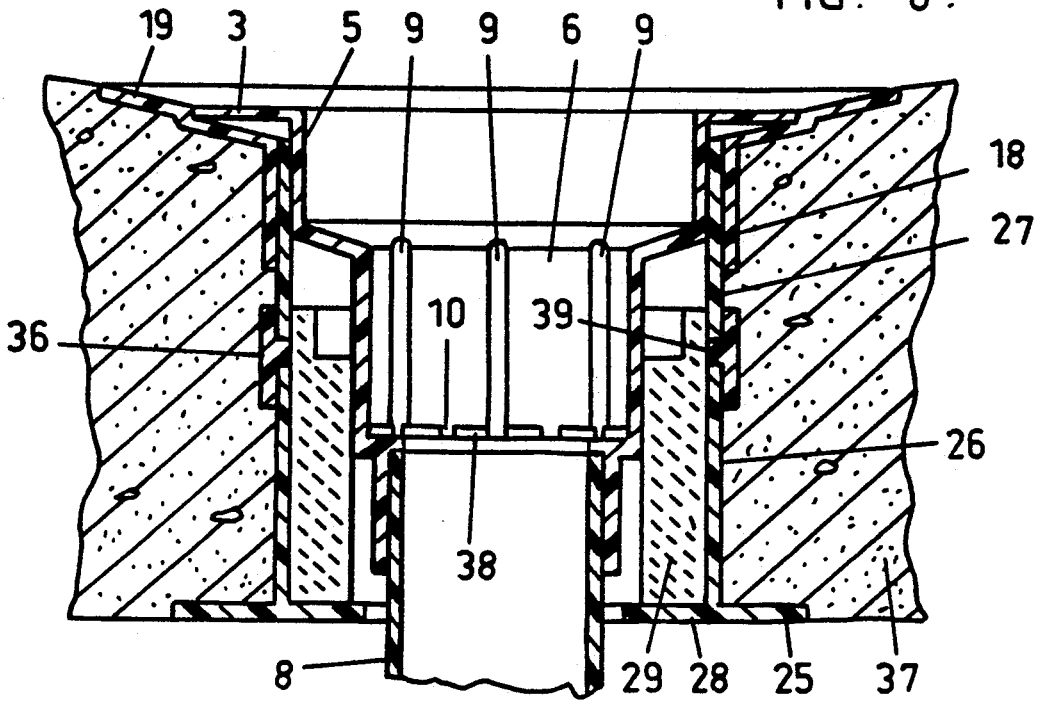
Figure 7:
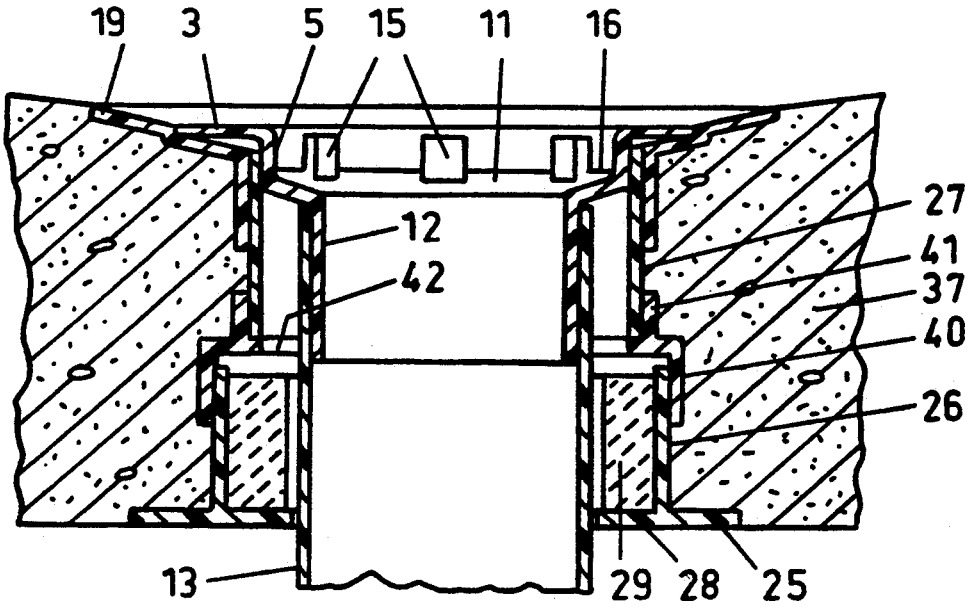
Figure 8:
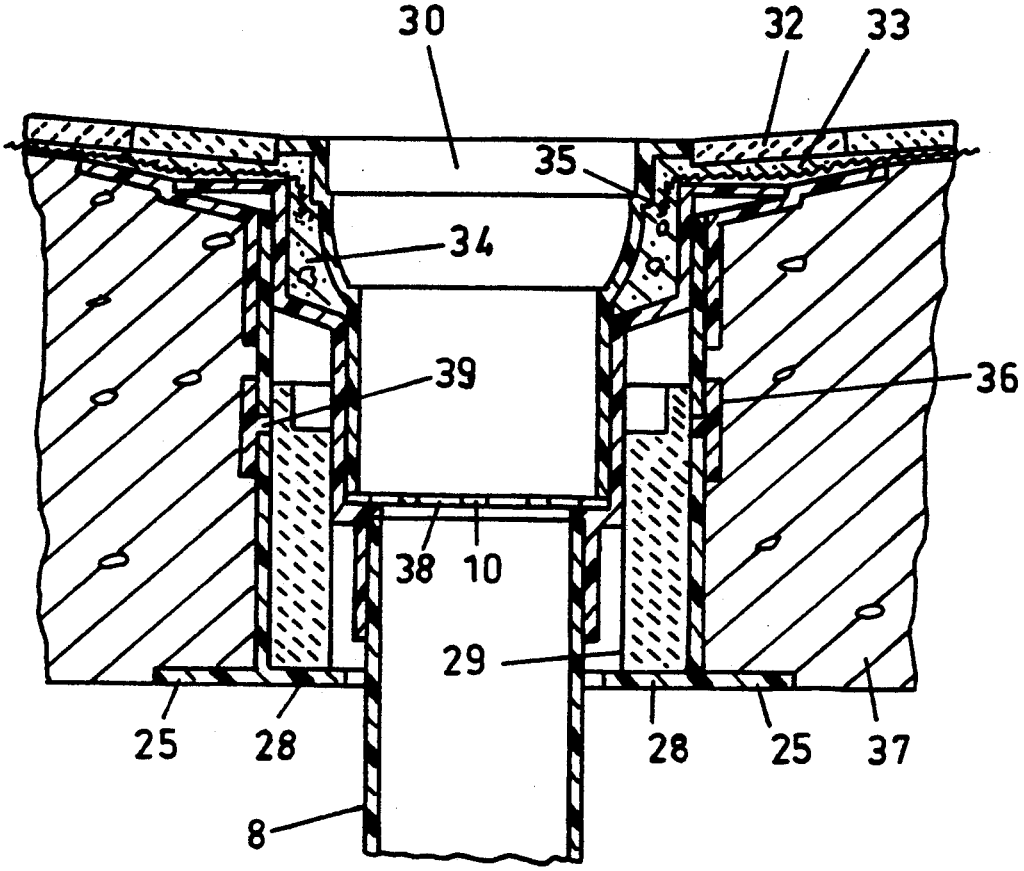

FIG. 3 shows an axial cross-section of a fall and cap member for use with the invention, FIG. 4 shows an axial cross-section of an installation of the first embodiment of the invention with a fall and cap member, FIG. 5 shows an axial cross-section of an installation of the second embodiment of the invention with a fall and cap member, FIG. 6 shows an axial cross-section of the installation of FIG. 4 for a 50 mm drain pipe and modified to provide a fire rated collar as would be used in high rise buildings, FIG. 7 shows a view similar to FIG. 6 but using a support of FIG. 2 and coupled to an 80 mm drain pipe, and, FIG. 8 shows the arrangement of FIG. 6 after the installation of a floor waste fitting in the support and the effect after tiling up to the top of the floor waste fitting.

Referring to FIG. 1 there is shown a floor waste fitting support according to a first embodiment of the invention. The support has a body 1 which is circular in cross-section but can be of other shapes. The body has an inlet end 2 and there is an outwardly directed continuous flange 3 around that end. It is to be understood that the invention is not dependent upon the flange and it would be possible under some conditions to have a support without a flange or with a minimal sized flange. There is a passageway through the body 1 extending between the inlet end 2 and the discharge end 4.

The bore of the body has several parts. Adjacent the inlet end 2 there is a large bore part 5 which is larger than the outside dimension of the floor waste fitting to be mounted in the support. In the downstream direction there is then a smaller diameter bore part 6 dimensioned to be a close fit, it can be a sliding fit or a friction fit, with the exterior of the body of the floor waste fitting to be supported. This is followed in the downstream direction by a still smaller bore part 7, which in the illustrated example is of a diameter to receive a plastic drain pipe 8 with a nominal 50 mm internal diameter.

The bore 6 and stop means in the form of lugs 38, at the junction of the bores 6 and 7, provide a positioning means for the floor waste fitting to be supported. The positioning means centralizes the waste fitting when mounted and limits the maximum inwards travel of the body of the waste fitting into the bore 6. If the fit between the bore 6 and the waste fitting is a frictional fit the friction can be used to provide a holding force to maintain the waste fitting in an intermediate position and spaced from the lugs. This can be of advantage in some instances where the height of the floor tiling has to higher than the level determined when the support of the invention is installed. The floor waste fitting can be readily positioned as aforesaid at the required finishing height with the top of the fitting providing a tile height level indicator.

There are channels 9 in the walls of the bore 6 to allow water entering the bore 5 to pass through the bore 6, even though the body of the waste fitting therein may be tightly gripped by the bore 6, then through the gaps 10 between the lugs 38 to the bore 7, or when a pipe 8 is fitted into the pipe 8.

In the embodiment of FIG. 2 there is again a body 1 with an inlet end 2 and a flange 3. It has a discharge end 4 and a bore 5 larger than the body of the waste fitting to be supported. There is a shoulder 11 at the transition point where the bores 5 and 12 meet, the latter being bored to receive a pipe of nominal 50 mm internal diameter and having an outside diameter dimensioned to enter into the bore of a pipe with a nominal 80 mm internal diameter, indicated 13.

The shoulder 11 is inclined inwardly towards the discharge end of the support body and there are a number of lugs 15 upstanding from the shoulder 11. The lugs 15 are arranged so that the outer faces of the lugs lie on a pitch circle having a diameter substantially the same as the diameter of the bore at the discharge end of the waste fitting to be mounted in the support. In this way the waste fitting is positioned laterally relative to the support and the passageway therethrough. The lugs 15 have outwardly directed abutment faces 16 which act as stop means and stand above the face of the shoulder 11 and the discharge end of the waste fitting when supported by the lugs 15 is held by the abutment faces 16 above the surface of the shoulder 11. In this way the lugs 15 and the abutment faces 16 provide positioning means including stop means for the waste fitting engagement with the support.

It follows that any water that enters the bore 5 will pass between the lugs 15 across the surface of the shoulder 11 and below the discharge end of the waste fitting held elevated by the abutment faces 16 and then first into the bore 12 and then the pipe 13.

FIG. 3 is a sectional elevation of a fall and cap member 17 for placement before the pouring of a concrete floor. By virtue of its construction the fall and cap member provides a guide for screeding freshly laid concrete to give an appropriate fall to the waste pipe and as the bore of the fall and cap member is initially blocked off cement cannot drop through the member 17 to lower floors or into pipework fitted thereto.

Specifically the fall and cap member comprises a tubular body 18 with a continuous outwardly directed flange 19 at one end, with the flange upper face angled to the axis of the bore 21 of the body 18. The upper face also includes a recess 20 dimensioned to receive the flange 3 of the support embodiments of FIGS. 1 and 2. The upper end of the bore 21 is occluded by a cap 22 edge connected (as by a frangible connecting means) in the mouth of the bore 21 for removal subsequent to the laying of a concrete floor.

The bore 21 of the fall and cap member is adapted to receive and have secured therein (as by gluing) a waste pipe 23 of 100 mm nominal inside diameter.

Referring to FIG. 4, there is illustrated an installation in which the fall and cap member of FIG. 3 is provided with a body extender sleeve 23 (a section of 100 mm plastic pipe) to the free end of which there is affixed a short foot sleeve 24 with an outwardly extending fixing flange 25. In the formation of a concrete floor the fixing flange 25 would be nailed or otherwise fixed to the concrete formwork and the height between the underface of the fixing flange and the top of the flange 19 would be the thickness of the concrete floor. In the screeding of the wet concrete the flange 19 serves as a screeding level and, as will be seen, the top surface of the concrete 37 is angled so that there is a fall towards the fall and cap member and any water on the surface of the concrete will flow to the cap and fall member.

After the concrete floor 37 is formed the cap 22 is removed leaving the bore of the extender sleeve 23 open. A support of the FIG. 1 type has been illustrated in FIG. 4. The flange 3 thereof is housed in the recess 20 and a sealant is used to seal the joint between the flange 3 and the recess 20. It will be noted that by appropriate dimensioning the outside diameter of the largest section of the body of the support, that is the portion around the bore 5, is a close fit in the bore of the extender sleeve 23.

FIG. 5 is a similar arrangement to FIG. 4 showing a support as illustrated in FIG. 2 installed.

Referring now to FIGS. 6, 7 and 8 there is illustrated the arrangement of FIGS. 4 and 5 modified to suit high rise building fire safety requirements. Those requirements provide for sealing of openings in floors in the event of fire and to that end the extension sleeve 23 of FIGS. 4 and 5 is modified. The modification includes having the body of the extension sleeve 23 in two pieces. Referring to FIGS. 6 and 8 which show a 50 mm drain pipe 8, the upper piece 27 of the sleeve 23 has a fall and cap member 17 fixed to it and its lower end is housed in a connector 36 with an annular internal shoulder therein identified 39. The upper end of the extender sleeve piece 26 is also housed in the connector 36 as can be readily seen from the drawings. The sleeve pieces 26 and 27 are secured in the connector 36 as by gluing to provide the required spacing of the flanges 19 and 25. Complementing the fixing flange 25 there is an inwardly extending retainer flange 28. A sleeve of intumescent material 29 is positioned within the body extender sleeve piece 26 and it sits on the retainer flange 28.

As will be seen from FIGS. 6 to 8 the sleeve 29 is a sliding fit over the drain pipe 8 and the configurations are varied to accommodate different sizes of the drain pipes 8. In operation where fire occurs the heat from below will cause the intumescent material to rapidly expand, as a result of an inherent quality of that material, and tightly grip the exterior of the pipe and/or support member within the sleeve 29 thereby closing off the gaps between the members.

FIG. 7 is a view similar to FIG. 6 for use with an 80 mm drain pipe 13. In this arrangement the sleeve part 7 and the upper part of the connector co-operate as they did in the FIG. 6 arrangement. The upper part of the connector in FIG. 7 comprises a collar 41 and an internal shoulder 42. The lower part 40 of the connector has a larger diameter than the upper part 27 (unlike FIG. 6 where they are the same diameter) so as to accomodate the sleeve of intumescent material 29 which needs to be of a larger diameter than that used in association with a 50 mm drain pipe. The thickness of the sleeve 29 needs to be maintained substantially the same for different diameter drain pipes in order that the intumescent material will function under heat conditions as required.

Referring specifically to FIG. 8. The floor waste fitting 30 has been mounted in the support of FIG. 1 and by design the top of the fitting 30 is a specific height above the flange 19. The height is a function of the surface treatment for the concrete floor. In the case of tiles it is the thickness of the tiles 32 and thickness of the bed 33 on which the tiles are mounted. In the FIG. 8 arrangement the tile bedding mortar 33 has been laid and entered into the gap between the floor waste fitting support and the bore 5 of the support as indicated 34, which serves as a catchment area for seepage water. In the event any water passes through the tile joints or around the tile-to-waste-fitting joint it will seep through the mortar indicated 34 and via the channels 9 and gaps 10 between the lugs 38 to the pipe 8 as discussed previously. To facilitate the seepage of water in a controlled manner once it has penetrated the floor finish a leach mat of threads (indicated 35 in FIG. 8) can be laid over the floor and the tile mortar would be laid thereon. The leach mat threads transfer water by capillary action.

It is to be understood that a leach mat can be used in the other installations for which the floor waste support of this invention has been devised. For example, leach mats are desirable where the FIGS. 1 and 2 embodiments are used with fiberboard and compressed fibro and like flooring materials.

The channels 9, lugs 8 and 15 illustrated and described herein can be varied in numbers as required. Plastics material is the preferred material for the manufacture of the support 1 and the other components such as pipes 8 and 23 and the connector 36.

I claim:

1. A waste water fitting support assembly for allowing seepage water entering said support externally of a waste water fitting mounted in said support to merge with waste water passing through the waste water fitting, said waste water fitting support comprising:

a support member having a body, an imperforate body wall circumscribing a stepped bore extending through said body, an outlet end for said stepped bore, an inlet end for said stepped bore with a continuous flange extending radially outwardly from said inlet end, a first bore portion extending into the bore from said inlet end for receiving seepage water from said continuous flange for defining an outer surface of an annular seepage water receiving zone, an inner surface of which is defined by a waste water fitting when mounted in said support member, a second bore portion extending into said bore from said outlet end, a transition bore portion separating the first bore portion and the second bore portion and including water leakage paths;

means for positioning including means for axially positioning and means for centrally positioning a waste water fitting in a support bore;

a bore size reducing shoulder in said transition bore portion adjacent the second bore portion and facing said inlet end;

abutment means adjacent said reducing shoulder at an elevation above said shoulder and facing said inlet end to axially position a waste water fitting in said support member by limiting the penetration of the waste water fitting into said bore for maintaining a discharge end of the waste water fitting clear of said shoulder, said means for centrally positioning the waste water fitting in said stepped bore of said support member extending away from said abutment means towards said inlet end of said bore being for axial sliding frictional engagement by a waste water fitting, said seepage water leakage paths extending through said abutment means for connecting said first bore portion to said bore downstream of said shoulder;

a fall and cap member having an elongated body, an axial opening through the elongated body with two ends, one end of said axial opening being dimensioned for receiving said support member, a positioning flange extending radially outwardly from said one end of said axial opening, an annular depression in said positioning flange extending outwardly from said one end of the axial opening wherein said continuous flange of said support member is housed.

2. The waste water fitting assembly according to claim 1, wherein said means for centrally positioning a waste water fitting in said bore of said support member is a part of said transition bore portion between said reducing shoulder and said first bore portion dimensioned to closely embrace a waste water fitting and the seepage water leakage paths are connected to said first bore portion by grooves in a wall of said part of said transition bore portion.

3. The waste water fitting assembly according to claim 1, wherein said means for positioning a waste water fitting in said bore of said support member include a plurality of lugs directed away from said shoulder towards said first bore portion for engagement by the discharge of a waste water fitting.

4. The waste water fitting assembly according to claim 1, further comprising a fixing flange extending outwardly from an end of said axial opening, opposite to that of said one end of said axial opening, through said fall and cap member.

5. The waste water fitting assembly according to claim 1, further comprising a retainer flange extending inwardly in an end of said axial opening, opposite to that of said one end of said axial opening, through said fall and cap member, an annular sleeve of intumescent material supported by said retainer flange and encircling said support member.

* * * * *